US005291971A

United States Patent [19]

Bovis

[11] Patent Number: 5,291,971

[45] Date of Patent: Mar. 8, 1994

[54] PLATFORM MECHANISM FOR A STAIR-LIFT

[75] Inventor: Jonathon C. Bovis, Hampshire, United Kingdom

[73] Assignee: Stannah Stairlifts Limited, Hampshire, United Kingdom

[21] Appl. No.: 39,282

[22] PCT Filed: Aug. 20, 1992

[86] PCT No.: PCT/GB92/01534

§ 371 Date: Apr. 19, 1993

§ 102(e) Date: Apr. 19, 1993

[87] PCT Pub. No.: WO93/03993

PCT Pub. Date: Mar. 4, 1993

[30] Foreign Application Priority Data

Aug. 20, 1991 [GB] United Kingdom ..... 9117965

[51] Int. Cl.[5] ..... B66B 9/08

[52] U.S. Cl. ..... 187/12; 414/921

[58] Field of Search ..... 187/12, 13, 14, 15, 187/62; 414/921

[56] References Cited

U.S. PATENT DOCUMENTS 5,072,810 12/1991 Theis ..... 187/62
5,125,481 6/1992 Shibata ..... 187/12
5,230,288 7/1993 Bickel ..... 414/921 X

FOREIGN PATENT DOCUMENTS 047574 3/1982 European Pat. Off. ..... 187/12 X
3136114 3/1983 Fed. Rep. of Germany ... 187/12 X

*Primary Examiner*—D. Glenn Dayoan
*Assistant Examiner*—Dean A. Reichard
*Attorney, Agent, or Firm*—Weiser & Associates

[57] ABSTRACT

A mechanism is provided for a stair-lift platform including a stair-lift carriage which runs up and down a flight of stairs and a platform which form a bridge to the carriage at the top of the stairs, the platform being lowered so as to constitute the bridge and raised out of the way when the carriage descends, the mechanism comprising a coupling unit fixed with respect to the stairs, a linkage from the coupling unit to the platform and a pick-up on the carriage, the pick-up engaging the coupling unit so as to cause a following movement of the coupling unit with respect to the carriage, which following movement causes the platform to be raised and lowered via the linkage.

4 Claims, 2 Drawing Sheets

PLATFORM MECHANISM FOR A STAIR-LIFT

BACKGROUND OF THE INVENTION

The invention relates to a platform mechanism for a stair-lift. A stair-lift generally comprises a rail which is mounted on a stair-case or on an adjacent wall and which carries a carriage with a chair or a platform for a wheel-chair to enable an infirm person to be carried up and down the stairs. If the stairs consist of one straight flight fabrication of the stair-lift is relatively straight forward. If the carriage is to negotiate curves, however, fabrication of the stair-lift becomes more complex and expensive.

Frequently stair-cases consist of a major flight turning through 90 degrees near the upper level through winders or a quarter landing to one or two further steps. In this configuration a straight stair-lift cannot serve the upper landing level directly and it is necessary to accept the greater cost of a curved stair-lift to achieve this.

One solution to the problem is to provide a hinged platform at the upper level. The platform may be hinged up to a parked position in order not to obstruct the stair-case. When the stair-lift is at or near the upper level the platform is swung down to form a bridge. The platform may be operated manually but this is difficult for a person seated on the stair-lift. If the platform is left down when the stair-lift descends it obstructs the stair-case and presents a serious hazard because someone may inadvertently step off the unprotected edge.

The problems can be overcome by providing powered operation for the platform, operated by push-button or automatically. However, the additional motor drive mechanism and control system is expensive. The present invention seeks to provide an improvement.

SUMMARY OF THE INVENTION

According to the invention there is provided a mechanism for a stair-lift platform, there being a stair-lift carriage which runs up and down a flight of stairs and a platform which forms a bridge to the carriage at the top of the stairs, the platform being lowered so as to constitute the bridge and raised out of the way when the carriage descends, the mechanism comprising a coupling unit fixed with respect to the stairs, a linkage from the coupling unit to the platform and a pick-up on the carriage, the pick-up engaging the coupling unit so as to cause a following movement of the coupling unit with respect to the carriage, which following movement causes the platform to be raised and lowered via the linkage.

Preferably the coupling unit is of limited extent and is mounted near the top of the stairs, the pick-up engaging therewith when the carriage is near the top of the stairs and disengaging therefrom otherwise.

Preferably the coupling unit comprises a continuous chain or belt running around upper and lower wheels or pulleys, the pick-up engaging with one or more lugs or the like on a run of the chain or belt. The linkage may comprise a wire rolled around a take-up spool coupled to one of the wheels or pulleys. Preferably, however, the linkage comprises a wire or the like fixed at one end to the chain or belt at such a position as to be drawn down to raise the platform by downward movement of the carriage so as first to pass around the center of the lower wheel or pulley with the platform raised to its uppermost position. This forms an over-center movement which securely locates the platform in its uppermost position.

BRIEF DESCRIPTION OF THE DRAWINGS

The invention will further be described with reference to the accompanying drawings, of which.

DETAILED DESCRIPTION OF THE PREFERRED EMBODIMENT

Figure 1:
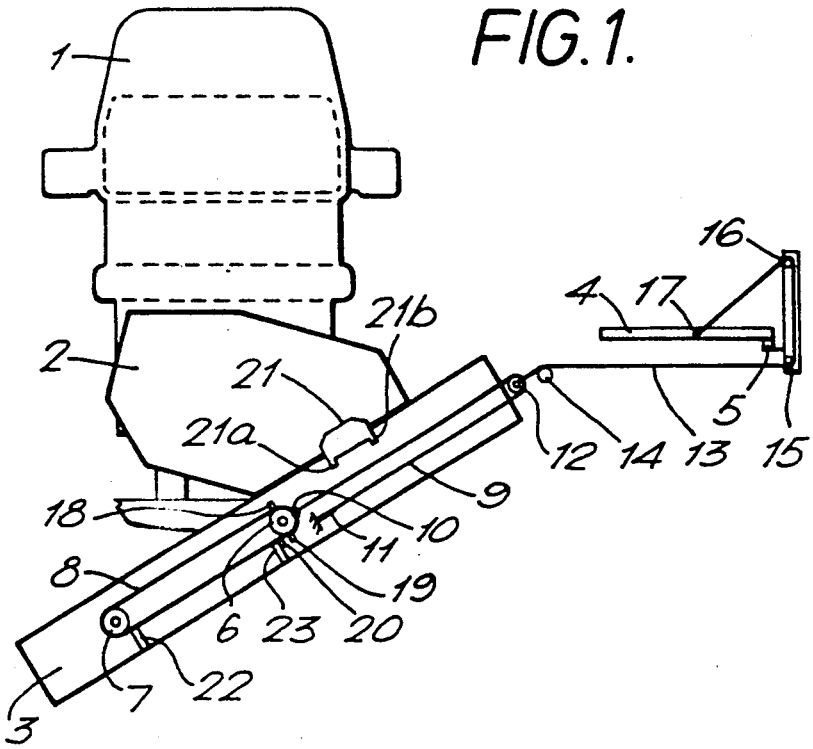
FIGS. 1 to 4 are respective diagrams of a stair-lift incorporating a mechanism according to the invention with the carriage of the lift in progressive stages of descent.

Referring to FIG. 1 there is shown a stair-lift which comprises a chair 1 mounted on a carriage 2 which runs on a rail 3 up and down a flight of stairs (not shown). At the top of the stairs is a platform 4 hinged at 5 which forms a bridge between the chair and a landing (not shown). When the chair is at the top of the stairs it is necessary for the platform to be in its lowered position shown in FIG. 1 but it is necessary to raise the platform when the chair descends. The mechanism to be described achieves this automatically.

Fixed on rail 3 are an upper pulley 6 and a lower pulley 7. An endless belt 8 runs on the pulleys and a wire 9 is attached by one end at 10 to the belt. The other end of the wire 9 is attached via a spring 11 to the rail 3. Wire 9 runs around a pulley 12 which is free to move one end of another wire 13. Wire 13 passes over pulleys 14, 15 and 16 and is attached to the platform 4 at 17. Lugs 18, 19 and 20 are fixed on the belt 8 and a pick-up 21 is fixed on the carriage to engage the lugs. Upper and lower stops 22 and 23 limit the movement of the belt.

Figure 2:
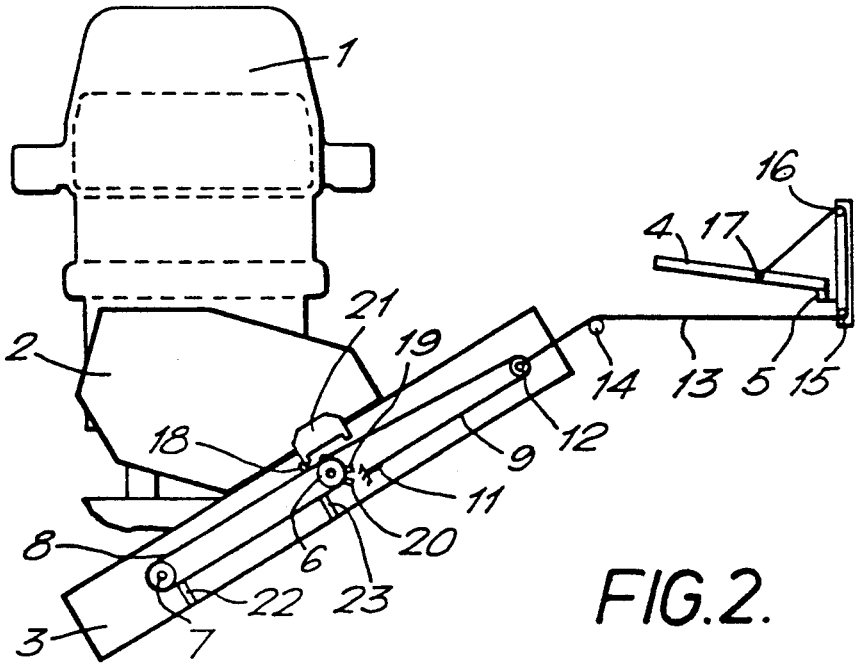

FIG. 1 shows the carriage near the top of the stairs and starting its descent. It is to be noted that the belt 8 is mounted near the top of the rail 3. FIG. 2 shows the pick-up 21 engaging lug 18 and starting to move the belt anti-clockwise as the carriage descends. Platform 4 begins to rise as a result of the movement of wires 9 and 13.

Figure 3:
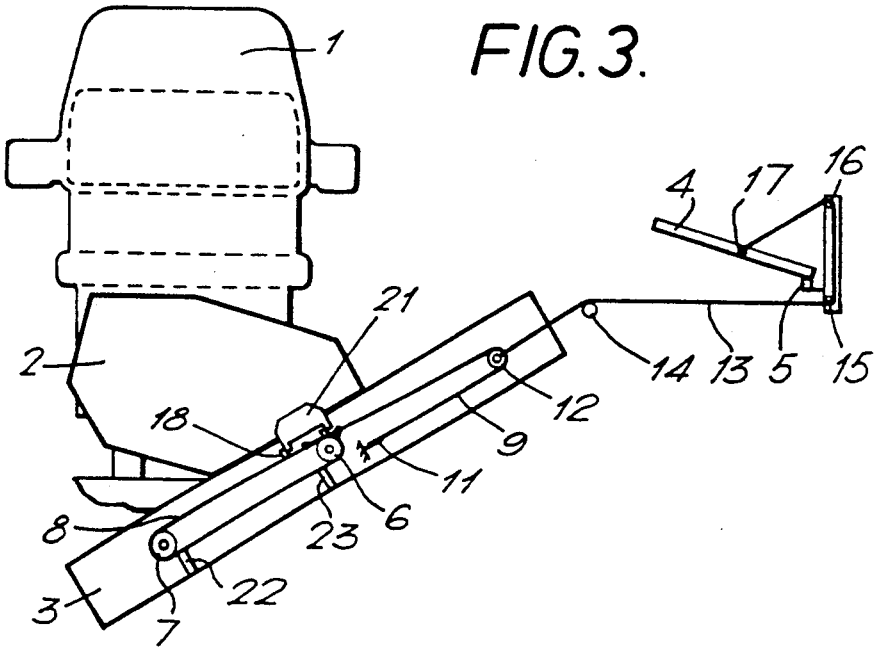

As the descent continues the second tooth **21*b* of two protruding teeth 21*a* and 21*b* of pick-up 21 engages between lugs 19 and 20 (FIG. 3**).

Figure 4:
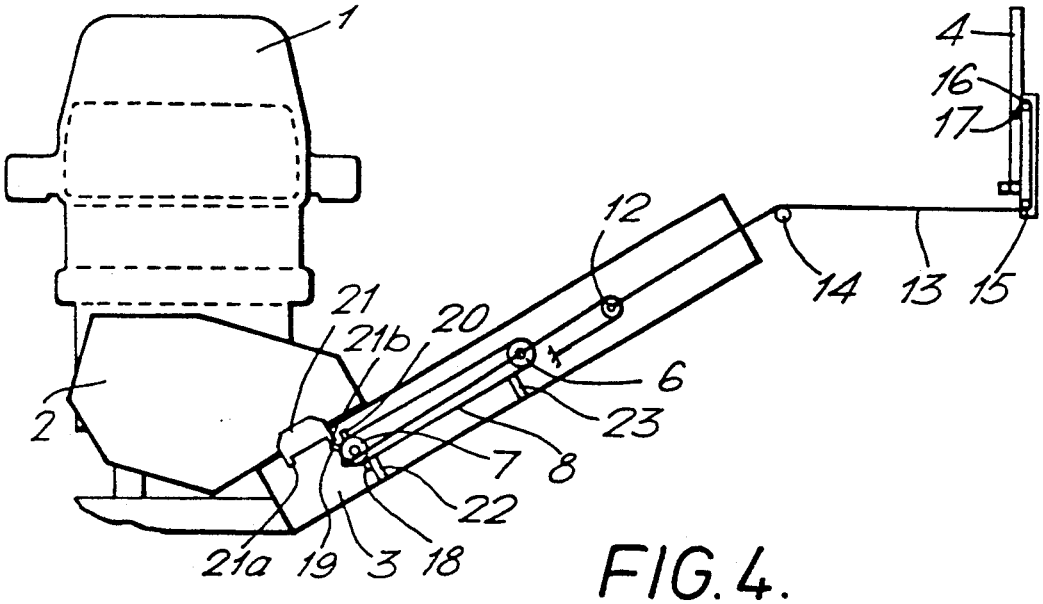

Finally, FIG. 4 shows the pick up about to disengage the lugs as the chair continues its travel to the bottom of the stairs (not shown). The belt at this time has reached the limit of its anti-clockwise travel and it will be noted that the platform 4 is fully raised. Also, it will be seen that the point of attachment 10 of wire 9 has passed beyond the center of the pulley 7 so that the weight of the platform acting through wires 9 and 13 now tends to pull the belt anti-clockwise instead of clock-wise. This pulls the lug 18 against the lower stop 22 and the mechanism is locked by this over-center arrangement after which point the stair-lift is free to travel to its lowest level without affecting the platforms position.

When the user of the stair-lift wishes to return upstairs the chair ascends and when near the top of the flight of stairs the tooth **21*b* enters between lugs 19 and 20 and the belt 8** is moved in a clock-wise direction by movement of the chair upwardly. Lowering of the platform is effected by the reverse sequence to that described above so that by the time the chair reaches the top of the stairs the platform is in the lowered. bridging, position.

I claim:

1. A mechanism for a stair-lift platform, there being a stair-lift carriage which runs up and down a flight of stairs and a platform which forms a bridge to the carriage at the top of the stairs, the platform being lowered so as to constitute the bridge and raised out of the way when the carriage descends, the mechanism comprising a coupling unit fixed with respect to the stairs, a linkage from the coupling unit to the platform and a pick-up on the carriage, the pick up engaging the coupling unit so as to cause a following movement of the coupling unit with respect to the carriage, which following movement causes the platform to be raised and lowered via the linkage.

2. A mechanism as claimed in claim 1 wherein the coupling unit is of limited extent and is mounted near the top of the stairs, the pick-up engaging therewith when the carriage is near the top of the stairs and disengaging therefrom otherwise.

3. A mechanism as claimed in claim 1 wherein the coupling unit comprises a continuous chain or belt running around upper and lower wheels or pulleys, the pick-up engaging with one or more lugs or the like on a run of the chain or belt.

4. A mechanism as claimed in claim 3 wherein the linkage comprises a wire or the like fixed at one end to the chain or belt at such a position as to be drawn down to raise the platform by downward movement of the carriage so as first to pass around the center of the lower wheel or pulley with the platform raised to its uppermost position.

* * * * *